United States Patent [19]

Jedlitschka et al.

[11] Patent Number: 5,060,253

[45] Date of Patent: Oct. 22, 1991

[54] HIGH-VOLTAGE BLOCK FOR AN X-RAY TUBE, THE BLOCK INCLUDING A COOLING TANK INTEGRATED WITH ITS SECONDARY CIRCUIT

[75] Inventors: Hans Jedlitschka, Chatillon-Sous-Bagneux; Jacques Sireul, Wissous, both of France

[73] Assignee: General Electric CGR S.A., Issy les Moulineaux, France

[21] Appl. No.: 617,100

[22] Filed: Nov. 23, 1990

[30] Foreign Application Priority Data

Nov. 24, 1989 [FR] France ..... 89 15509

[51] Int. Cl.[5] ..... H05G 1/10

[52] U.S. Cl. ..... 378/101; 378/200; 378/202

[58] Field of Search ..... 378/101, 199, 200, 201, 378/202

[56] References Cited

U.S. PATENT DOCUMENTS

| | | |
|---|---|---|
| 3,510,748 | 5/1970 | Sakamoto et al. . |
| 3,541,424 | 11/1970 | Tada et al. . |
| 3,971,946 | 7/1976 | Craig et al. . |
| 4,338,657 | 7/1982 | Lisin et al. . |
| 4,694,480 | 9/1987 | Skillicorn . |

FOREIGN PATENT DOCUMENTS

| | | |
|---|---|---|
| 0003946 | 9/1979 | European Pat. Off. . |
| 3125240 | 3/1982 | Fed. Rep. of Germany . |
| 2239040 | 2/1975 | France . |

*Primary Examiner*—Craig E. Church

*Attorney, Agent, or Firm*—Oblon, Spivak, McClelland, Maier & Neustadt

[57] ABSTRACT

The invention relates to high-voltage power supplies for X-ray tubes in radiological apparatuses. The invention lies in the fact that the secondary windings of the transformer, the capacitors, and the diodes of the rectifier and voltage-doubler circuits, are all disposed in an enclosure made from two half-shells, whereas the primary winding and the magnetic circuit are disposed outside the enclosure.

11 Claims, 7 Drawing Sheets

X'
55
64
35
45
41
60
34
44
28
27
31
21
26
29
26
12'
C2
C15
B2
37
13
36
23
33
B1
20
32
22
22
24
25
38
40
46
X

HIGH-VOLTAGE BLOCK FOR AN X-RAY TUBE, THE BLOCK INCLUDING A COOLING TANK INTEGRATED WITH ITS SECONDARY CIRCUIT

BACKGROUND OF THE INVENTION

1. Field of the invention

The invention relates to electrical power supplies used for powering X-ray tubes, and more particularly, in such power supplies, it relates to means for supporting and cooling the various electric circuit components.

2. Description of the prior Art

An X-ray tube comprises a filament type cathode which emits a beam of electrons towards an anode or anticathode. The anode is made of a substance such as tungsten or molybdenum which emits X-rays when bombarded by the electron beam from the cathode. In order to obtain a beam of high-energy electrons, the electrons are accelerated by an intense electric field set up between the cathode and the anode. To this end, the anode is raised to a positive potential of several tens of kilovolts relative to the cathode, and this potential may exceed 100 kilovolts and may even reach 140 kilovolts.

Such voltages are provided by high-voltage power supplies which, as shown in FIG. 1, comprise a transformer 10 which is connected to rectifier and voltage-doubler circuits More precisely, the transformer 10 has a single primary winding 12 to which an alternating voltage is applied, and a secondary circuit 13 which is connected to the rectifier and voltage- doubler circuits In conventional manner, each rectifier and voltage-doubler circuit 11 consists in a single secondary winding 14, two diodes D1 and D2, and two capacitors C1 and C2 which are interconnected as shown in FIG. 1. Each rectifier and voltage-doubler circuit is connected to the following such circuit so that their output voltages are added together, thereby obtaining a very high voltage on the last voltage-doubler circuit of the assembly.

More precisely, the transformer comprises a primary winding 12 and twelve secondary windings S1 to S12, with secondary windings S1, S5, S6, and S12 being shown in the figure. Similarly, it includes twenty-four identical rectifier diodes D1 to D24, with components D1, D2, D3, . . . , D12, D13, D14, . . . , D22, D23, and D24 being shown in the figure.

The circuit also includes twenty-four filter capacitors C1 to C24 with capacitors C1, C2, C3, . . . , C12, C13, C14, . . . , C23, and C24 being shown in the figure.

Each of the secondary windings S1 to S12 has two output terminals. Taken together, the output terminals have references B1 to B24, but only the following terminals are shown in the figure: B1, B2, B3, . . . , B5, B6, B7, B8, . . . , B23, and B24.

In FIG. 1 the common point between capacitor C1 and diode D1 constitutes the high-voltage output terminal HT via a resistor R, and the common point between capacitor C24 and diode D24 constitutes the ground output terminal which is associated with a discharge gap 9.

In order to measure the amplitude of the high-voltage the output terminal HT is connected to a measurement circuit (not shown) connected to a point M via a resistor R′ and a variable capacitor C′. The point M is connected to ground by a discharge gap 9′.

In a typical embodiment, each rectifier and voltage-doubler circuit has an output voltage of 6 kilovolts such that the voltage at the output from the twelfth rectifier and voltage-doubler circuit is seventy-two kilovolts.

It may be observed that in order to obtain a potential difference of about 140 kilovolts between the cathode and the anode of an X-ray tube, the cathode is connected to a negative potential of 70 kilovolts relative to ground while the anode is connected to a positive potential of 70 kilovolts relative to ground. To this end, two power supply circuits are used, both being identical to that shown in FIG. 1.

It will be understood that making a high-tension power supply as shown in FIG. I gives rise to insulation problems which are often solved by keeping conductors that are at very different potentials well apart from one another and by interposing an insulating medium between them such as oil, which medium also serves as a cooling liquid. The resulting apparatuses are large and bulky.

Further, X-ray tubes are being used more and more frequently under pulse conditions at ever increasing repetition rates. In the circuit of FIG. 1, this means that the primary winding is fed with an alternating voltage at a high frequency, of the order of several tens of kilohertz. Under such new operating conditions, the performance of the circuit shown in FIG. 1 is limited by the stray inductance and capacitance of the conductors and of the transformer windings whose values are difficult to establish and to compensate.

In French patent application number 89 01357, filed Feb. 2, 1989 and entitled "A high-voltage power supply for an X-ray tube", the Applicant describes a power supply in which the relative positions of the various components tend to minimize stray inductance and capacitance, and contribute to reducing the overall bulk of the assembly while being very easy to assemble.

Further, by making the secondary circuit in the form of concentric windings, it is only the stray capacitance between the first secondary winding and ground which has any effect while the other stray capacitances between the various secondary windings have no effect since they are at an A.C. voltage.

In order to restrict the lengths of the connection conductors interconnecting the output terminals B1 to B24 of the secondary windings S1 to S12 firstly to the diodes D1 to D24 and secondly to the capacitors C1 to C24, the invention of the above-mentioned patent application provides firstly for making the secondary windings so that their similar odd-number terminals B1, B3, . . . , B23, are disposed on a first side of the windings while their even-numbered output terminals B2, B4, . . . , B24 are disposed on the other or second side of the secondary windings.

It is then provided that the diodes D1 to D24 are installed on a common support which is disposed on the same side as output terminals B1, B3, . . . , B23 of the secondary winding. The capacitors C1 to C24 are provided on the outer periphery of the secondary windings and their connections are made firstly to the diodes D1 to D24 on the first side of the secondary windings, and secondly to the output terminals B2, B4, . . . , B24 on the second side of the secondary windings. This particular disposition of the various components will be better understood with reference to the description of FIGS. 2 and 3 in which items that are identical to those shown in FIG. 1 have the same references.

The power supply comprises two half-shells 20 and 21 in which housings are provided for receiving the primary winding 12′ the secondary windings S1 to S12, the capacitors C1 to C24, and the diodes D1 to D24. To this end, each of the half-shells 20 (or 21) has three annular compartments 22, 23, and 24 (or 26, 27, and 28) disposed around a cylindrical central portion 25 (or 29).

The first annular compartment 22 (or 26) is at the periphery of the central portion 25 (or 29), whereas the second annular compartment 23 (or 27) is at the outer periphery of the first compartment 22 (or 26). The third compartment 24 (or 29) is disposed to one side of the first two compartments 22 and 23 (or 26 and 27) and is separated therefrom by respective partitions 30 and 31 (or 32 and 33) which are pierced by orifices.

The central portions 25 and 29 are designed to receive, in particular, the primary winding 12 and one of the branches 34 of the magnetic circuit 35 of the transformer 10. The first annular compartments 22 and 26 are designed to house the secondary windings 13 which are wound concentrically on a mandrel 36. The outer periphery of the mandrel 36 is closed by a cover constituted by a cylindrical ring 37. The mandrel 36 and its cover 37 fit inside the compartments 22 and 26. The second annular compartments 23 and 27 have twenty-four cells A1, A2, A3, . . . , A15, A15, A16, A24 which are designed to house respective ones of the twenty-four capacitors C1 to C24.

The third compartment 24 of the half-shell 20 is designed to house the diodes D1 to D24 and to provide the connections therebetween, their connections with the capacitors C1 to C24, and their connections with some of the output terminals of the secondary windings S1 to S12. This disposition is described in greater detail below with reference to FIG. 4.

The third compartment 28 of the half-shell 21 is designed to provide the various connections between some of the output terminals of the secondary windings S1 to S12 and the capacitors C1 to C24 as described below with reference to FIG. 5.

Each of the annular compartments 24 or 28 is closed by a respective annular cover 40 or 41 which fits around the outer periphery of the associated compartment. In order to enable the magnetic circuit 35 to be disposed close to the secondary windings, the periphery of each of the half-shells 20 (or 21) is interrupted by a notch 42 (or 43) and the same applies to each of the covers 40 (or 41). The notch serves to pass one of the branches of said magnetic circuit.

As shown in FIG. 4, the diodes D1 to D24 are disposed on a printed circuit in the form of a sector of an annular plate which provides the connection therebetween, the connections with one of the ends of each of the diodes C1 to C24, and the connections with the output terminals B1, B3, . . . , B23 in accordance with the circuit diagram of FIG. I. Thus, by way of example, the diode D1 has its cathode connected to the terminal B1 of the winding SI and its anode connected to one of the ends of the capacitor C1. In addition, the terminal B1 is connected to the anode cf the diode D2 the cathode of which is connected firstly to the anode of the diode D3 and secondly to one terminal of each of the capacitors C2 and C3, with the connection to the capacitor C3 taking place via a printed conductor CI1. It may be observed that the other printed conductors CI2 to CI11 connect other points common to diodes equivalent to D2 and D3 to capacitors equivalent to C3.

FIG. 5 is a plan view with the cover 41 partially cut-away, showing the other side of the secondary windings. In this figure, only connection conductors CC5 to CC10 between the terminals B6, B8, and B10, and the associated capacitors (C5, C6), (C7, C8), and (C9, C10) are shown. Of course, the conductors CC5 to CC10 may be made in the form of a printed circuit analogous to the printed circuit 38 carrying the diodes, or else in the form of a strip.

FIG. 5 also shows three of the four branches of the magnetic circuit 35 which has one of its branches housed in the notch 43.

The various components described above with reference to FIGS. 1 to 5 are assembled by being fitted within one another and they are held together by assembly components so as to obtain the assembly shown in partial section in FIG. 6. The assembly elements (not shown in FIGS. 1 to 5) are constituted by threaded tie bars together with nuts and support plates for holding the various branches of the magnetic circuit 35.

Thus, the components shown in FIG. 2 are held together by two threaded tie bars with nuts such as those referenced 50, 51, and 52 (FIGS. 2 and 6), with the tie bars being housed in holes 53 and 54 (FIG. 5) passing through the components shown in FIG. 2 from one side of the assembly to the other along axes parallel to the axis x'x.

Further, in order to support and hold the magnetic circuit 35 in place, plates 55 and 56 are provided (FIGS. 2 and 6) with these plates being held against respective ones of the covers 41 and 40 by threaded tie bars and nuts such as those referenced 57, 58, and 59 in FIGS. 2 and 6. Each of these plates 55 and 56 is designed to house and hold one of the branches of the magnetic circuit. Thus, the plate 55 supports the branch 60 of the U-shaped portion whereas the plate 56 supports the branch 46 of the magnetic circuit for closing the opening of the U-shape.

The device shown in FIG. 6 is placed inside an enclosure 61 (FIG. 7) filled with an insulating cooling fluid. To this end, it is mounted on a support plate 62 which constitutes the cover of the enclosure 61. It is mounted on the support plate 60 by means of two feet 63 and 64 which co- operate with retaining plates 55 and 56 by engaging in housings (not shown) provided therein. These feet 63 and 64 are pierced by holes such as the hole referenced 65 through which screws (not shown) are passed and then engaged in tapped holes in the cover 62.

The cover 62 also supports an insulating insert 66 which supports the high-voltage output terminal of the power supply. The other electrical terminals of the power supply are not shown in FIG. 7.

In spite of the considerable reduction in the bulk of the power supply, the enclosure 61 must nevertheless be sufficiently large to contain a large volume of cooling liquid, about 15 liters to 20 liters, which volume gives rise to a high-voltage power supply assembly which is relatively bulky.

BRIEF DESCRIPTION OF THE INVENTION

The object of the present invention is therefore to provide an X-ray tube power supply of the type described in the above-mentioned patent, but in which the enclosure containing the cooling liquid is reduced in size so as to obtain an assembly which is more compact and lighter.

To this end, the invention proposes a high-voltage block for an X-ray tube in which the enclosure containing the refrigerating and insulating medium contains only the secondary circuit, with the primary circuit and the magnetic circuit being disposed outside said enclosure.

The present invention provides a high-voltage power supply for an X-ray tube, the power supply comprising a transformer having at least one primary winding, a plurality of secondary windings, and a magnetic circuit, the two output terminals of each of said secondary windings being connected to a rectifier and voltage-doubler circuit constituted by two diodes and two filter capacitors, said rectifier and voltage-doubler circuits being interconnected so that their output voltages are added, the primary and secondary windings of the transformer being wound as concentric coils, the output terminals of said secondary windings being distributed on each of the sides of said coils, the capacitors being disposed on the outer periphery of the coils, and the diodes being disposed on one of the sides of said coils, wherein said secondary windings of the transformer, said capacitors, and said diodes, are all disposed in an enclosure which is filled with an insulating and cooling medium, said primary winding and said magnetic circuit being disposed outside said enclosure.

This enclosure is made by means of two half-shells which have cells for housing and holding the various components of the secondary circuit together with other components which are connected to high-voltage such as the, or each, transformer of the power supply-(ies) for the cathode filament(s).

Each half-shell includes two facing tunnels going right through and serving as a support or the inside of the enclosure for the secondary windings and on the outside of the enclosure for the primary winding and for the magnetic circuit.

BRIEF DESCRIPTION OF THE DRAWINGS

Other features and advantages of the present invention appear from reading the following description of a particular embodiment, said description being made with reference to the accompanying drawings, in which:

FIGS. 1 to 7 which are used above in the description of a prior art X-ray tube high-voltage power supply will not be described again; however, apart from FIG. 7, they nevertheless form an integral portion of the description of the invention with respect to the particular arrangement of the electrical and magnetic components and of the voltage-doubler circuits of the transformer. Thus, components shown in FIG. 8 which are identical or similar to those shown in FIGS. 1 to 6 are given the same references. It should nevertheless be observed that the two half-shells 20 and 21 of the embodiment shown in FIGS. 2 to 6 are now combined in a single shell which is referenced 20, 21 in FIG. 8.

DETAILED DESCRIPTION OF THE INVENTION

The present invention is based on the observation that the energy dissipated in an X-ray tube power supply approximately comprises: a first third in the primary circuit; a second third in the secondary circuit; and a third third in the magnetic circuit; while insulation problems due to high tension apply only to the components of the secondary circuit. That is why it is necessary to use a cooling medium which is also a very good insulator, which quality is not required for insulating the components of the primary circuit and of the magnetic circuit which can therefore be allowed to stand in open air.

The invention thus relates to an X-ray tube power supply in which only the components of the secondary circuit are disposed in a tank filled with a cooling and insulating medium, with the tank being shaped to serve on its inside as a support for the components of the secondary circuit and on its outside as a support for the components of the primary circuit and of the magnetic circuit.

Figure 8:
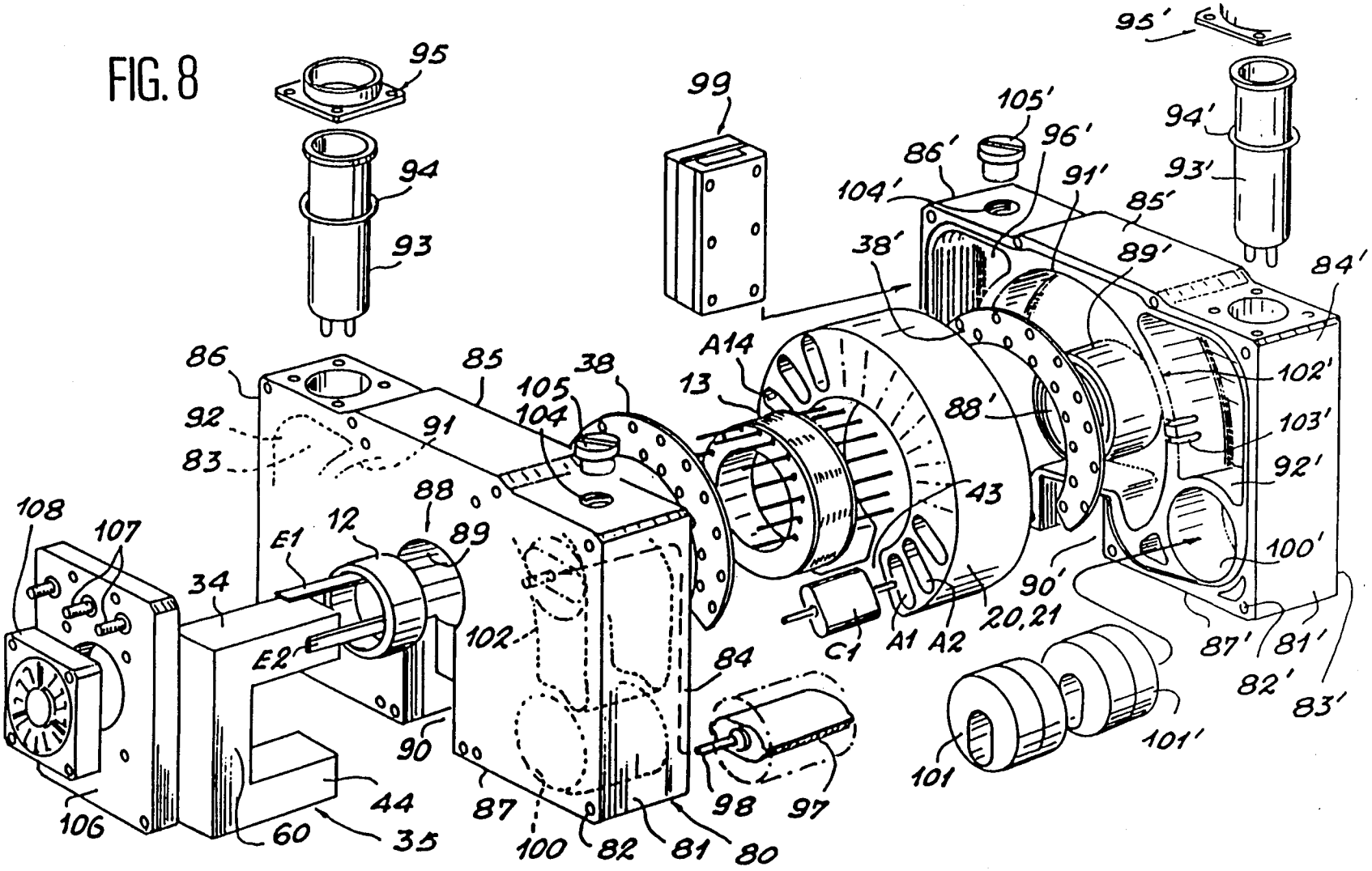
FIG. 8 is an exploded isometric perspective view of an X-ray tube high-voltage block in accordance with the invention.

As shown in FIG. 8, the tank 80 comprises two half-shell portions 81 and 81' which are assembled together by means of tie bars (not shown) passing through holes such as those referenced 82 and 82'passing through the thicknesses of the half-shells 81 and 81' respectively. A gasket (not shown) is provided for ensuring that the tank is fluid-tight after the two half-shells have been assembled together. The inside of each half-shell 81 and 81' is shaped in substantially the same manner in order to serve as an assembly support for various components, in particular the components of the secondary circuit. Thus, each half-shell 81 or 81' comprises a main wall 83 or 83' from which there project side walls 84 or 84', 85 or 85', 86 or 86', and 87 or 87'. Each main wall 83 or 83' is pierced substantially in the middle by a hole 88 or 88', thereby forming a tunnel 89 or 89' passing right through each half-shell 81 or 81'. The circular inside ends of the tunnels 89 and 89' come into abutment against each other when the two half-shells are assembled together with a sealing gasket (not shown) being sandwiched between them.

Each half-shell has an L-shaped notch 90 or 90' with its vertical arm situated in the main arm 83 or 83' while its horizontal arm is situated in side wall 87 or 87'. The depth of the vertical arm is less than the thickness of the half-shell and the depth of the horizontal arm is less than the distance between the tunnel and the side wall 87 or 87'.

The inside volume of each half-shell includes cells for receiving and holding components of the secondary circuits together with other components. Thus, a first cell 91 or 91' is provided around the tunnel 89 or 89' for supporting and holding the secondary windings 13 together with the shell (20, 21) containing the capacitors, the diodes, and the circuits interconnecting these various components mounted on printed circuits which are horseshoe shaped, as is the shell (20, 21). A second cell 92 disposed in half-shell 11 and a third cell 92' disposed in half-shell 81' are used for installing respective high-voltage connectors 93 and 93'. Each of the connectors 93 and 93' is made in conventional manner in the form of a sleeve whose closed end carries connection inserts situated inside the cell close to the output terminal of the secondary winding, and whose open end serves to pass the output conductors via a male plug (not shown in FIG. 8). The sleeve is hermetically mounted in an orifice through the side wall 85 or 85' by means of a gasket 94 or 94' and a plate 95 or 95' which is screwed to the side wall.

A fourth cell 96 disposed in half-shell 81 for housing an air-filled vessel 97 for compensating expansion of the insulating and cooling medium. The inside of this expansion vessel communicates with the outside of the tank via a duct 98. A fifth cell 96' disposed in half-shell 81' receives a voltage-measuring electric circuit 99.

Figure 1:
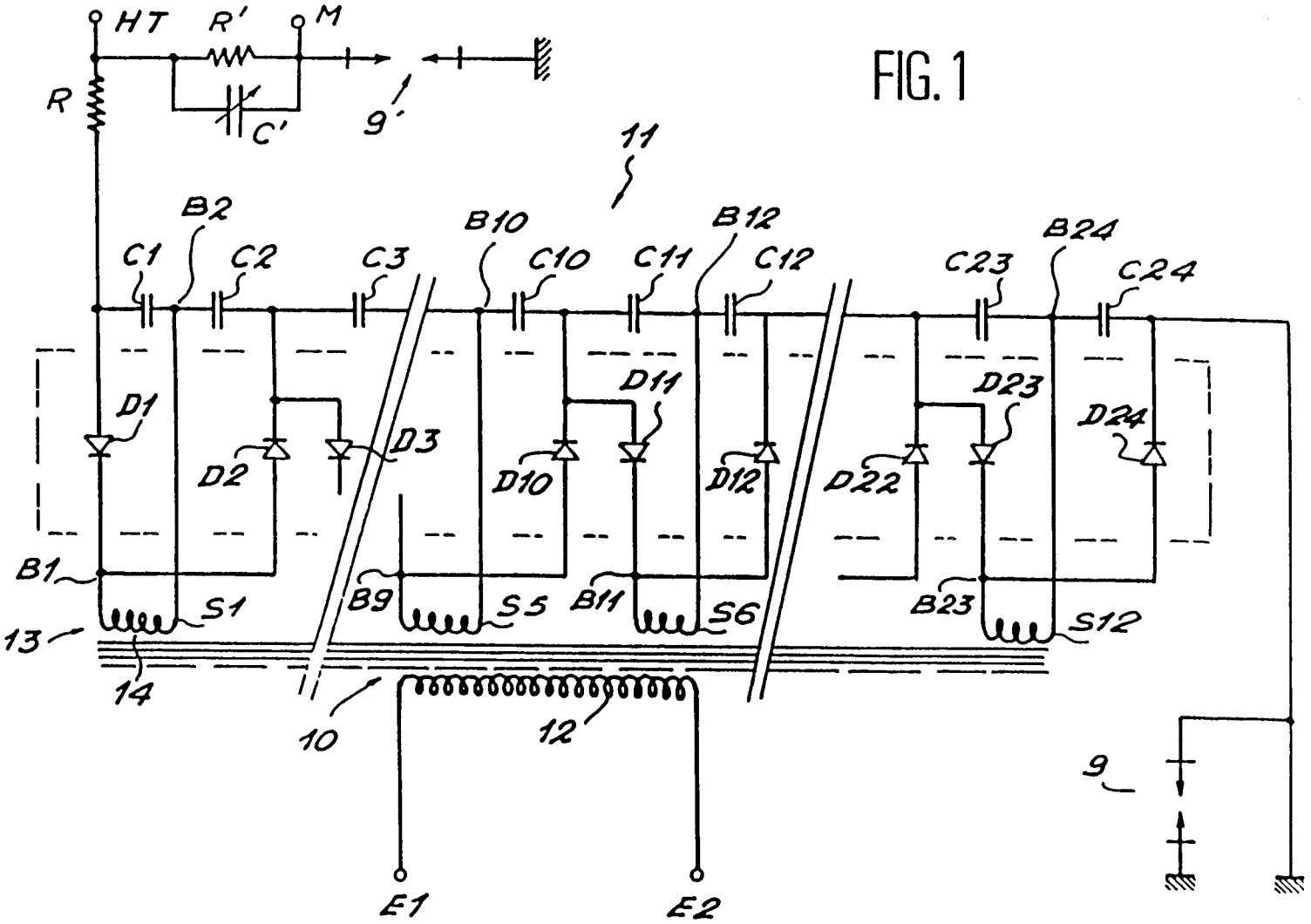
FIG. 1 is a conventional electrical circuit diagram of a high-voltage power supply for an X-ray tube.
Figure 2:
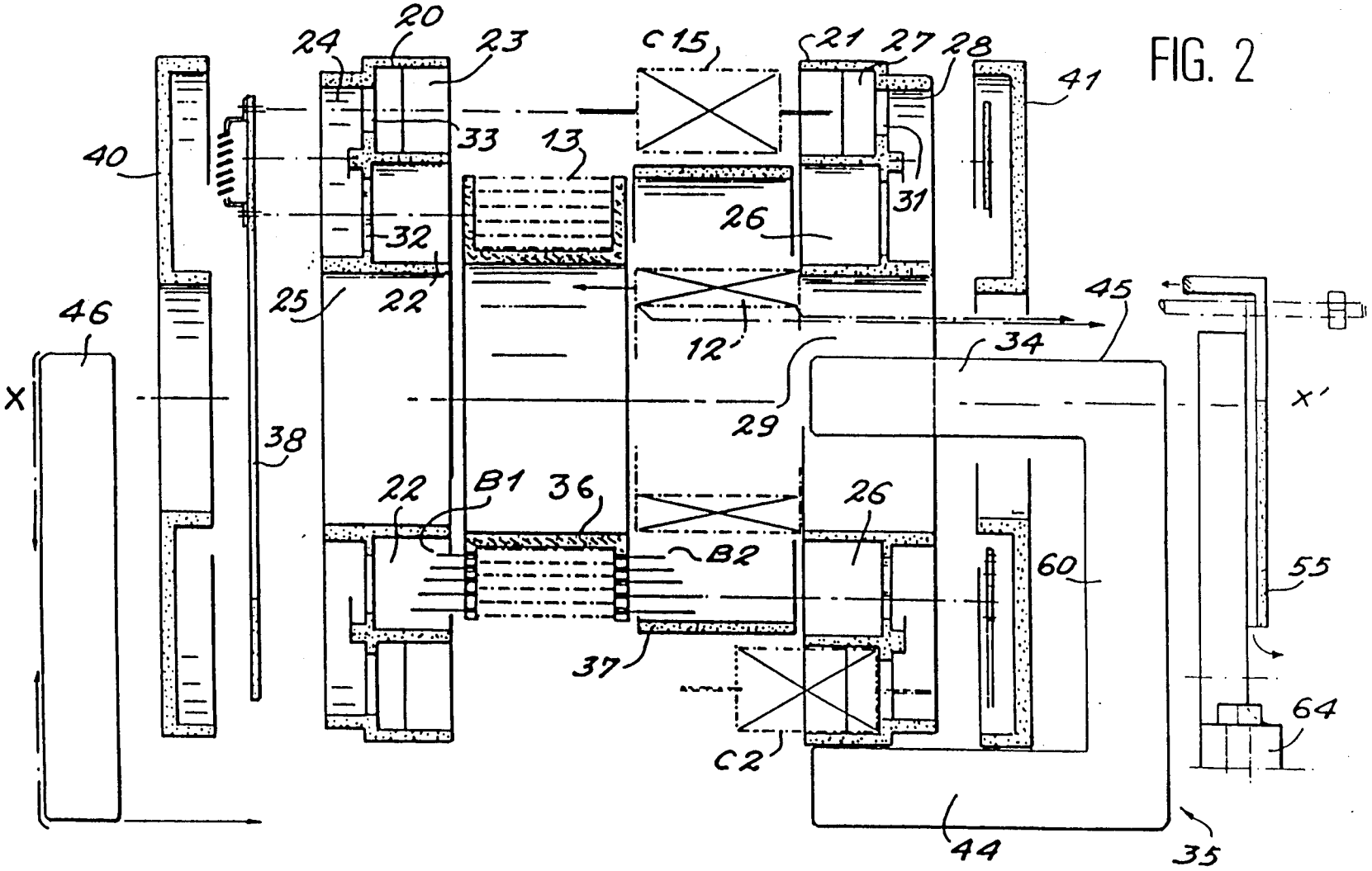
FIG. 2 is an exploded section view through a portion of a prior art power supply, along a longitudinal axis x'x of symmetry for the transformer windings.
Figure 3:
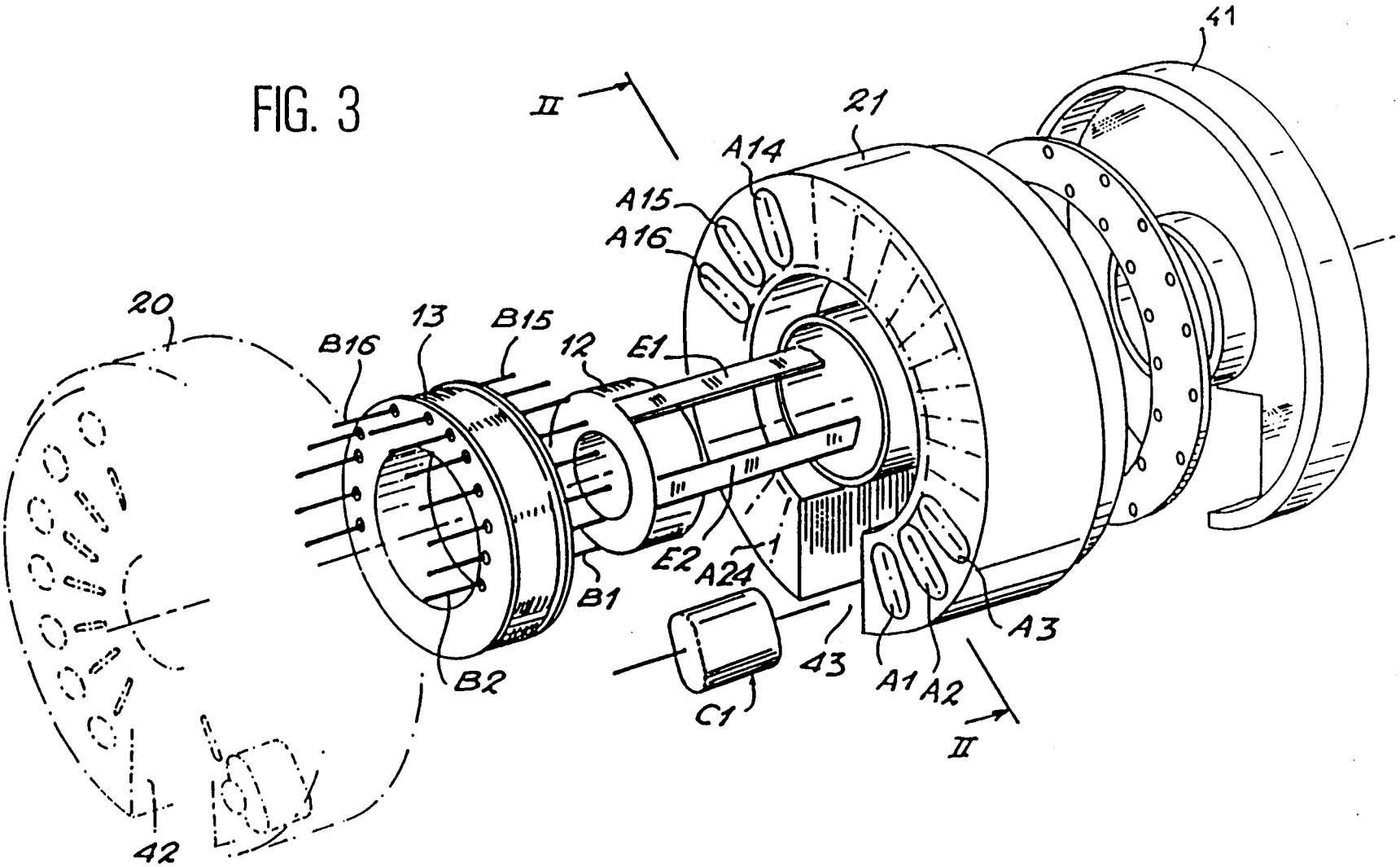
FIG. 3 is an exploded isometric perspective view of some of the components constituting the prior art power supply.
Figure 5:
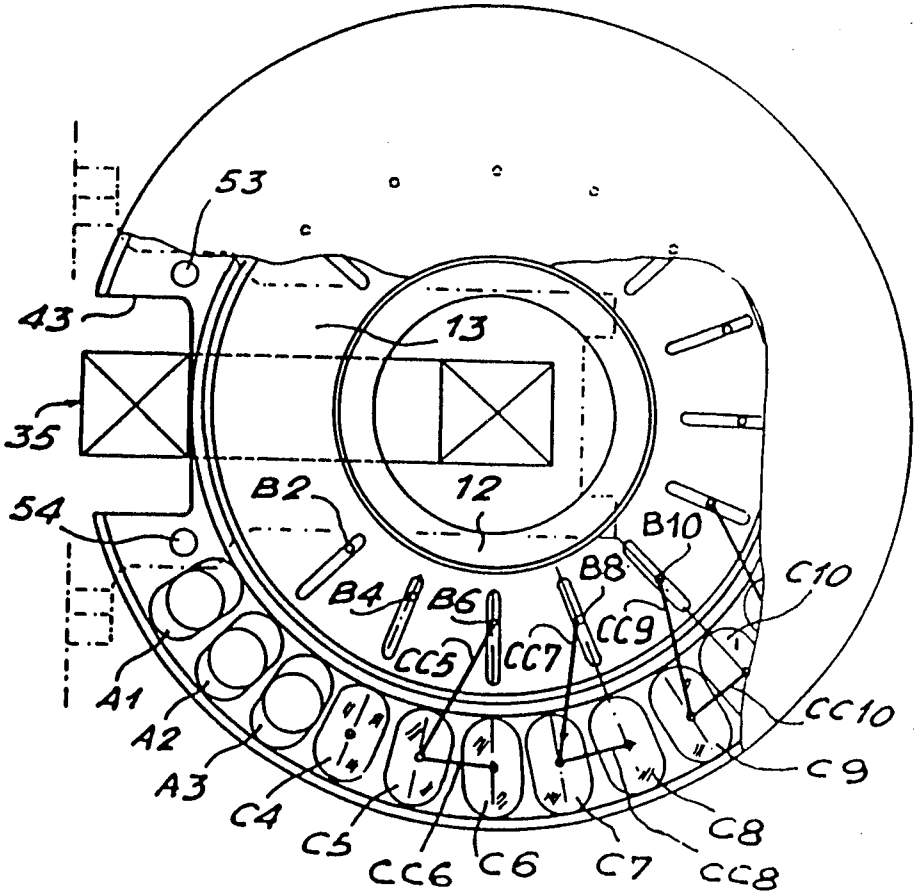
FIG. 5 is a partially cut-away plan view showing, in particular, the cells which receive the FIG. 1 capacitors.
Figure 4:
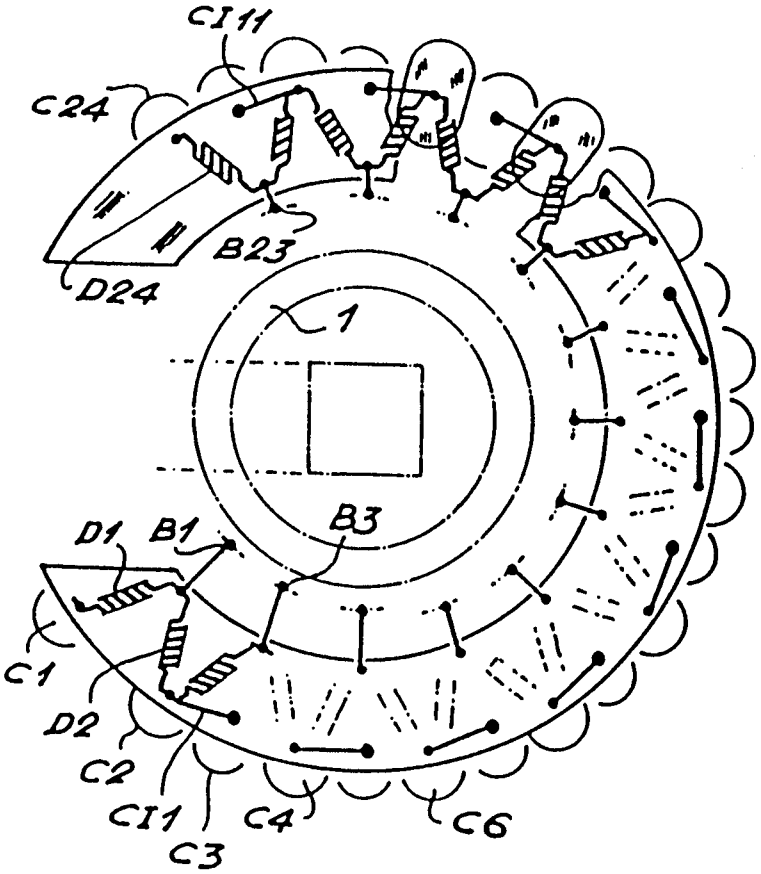
FIG. 4 is a plan view of the component on which the diodes of the FIG. 1 circuit are disposed and electrically connected.
Figure 6:
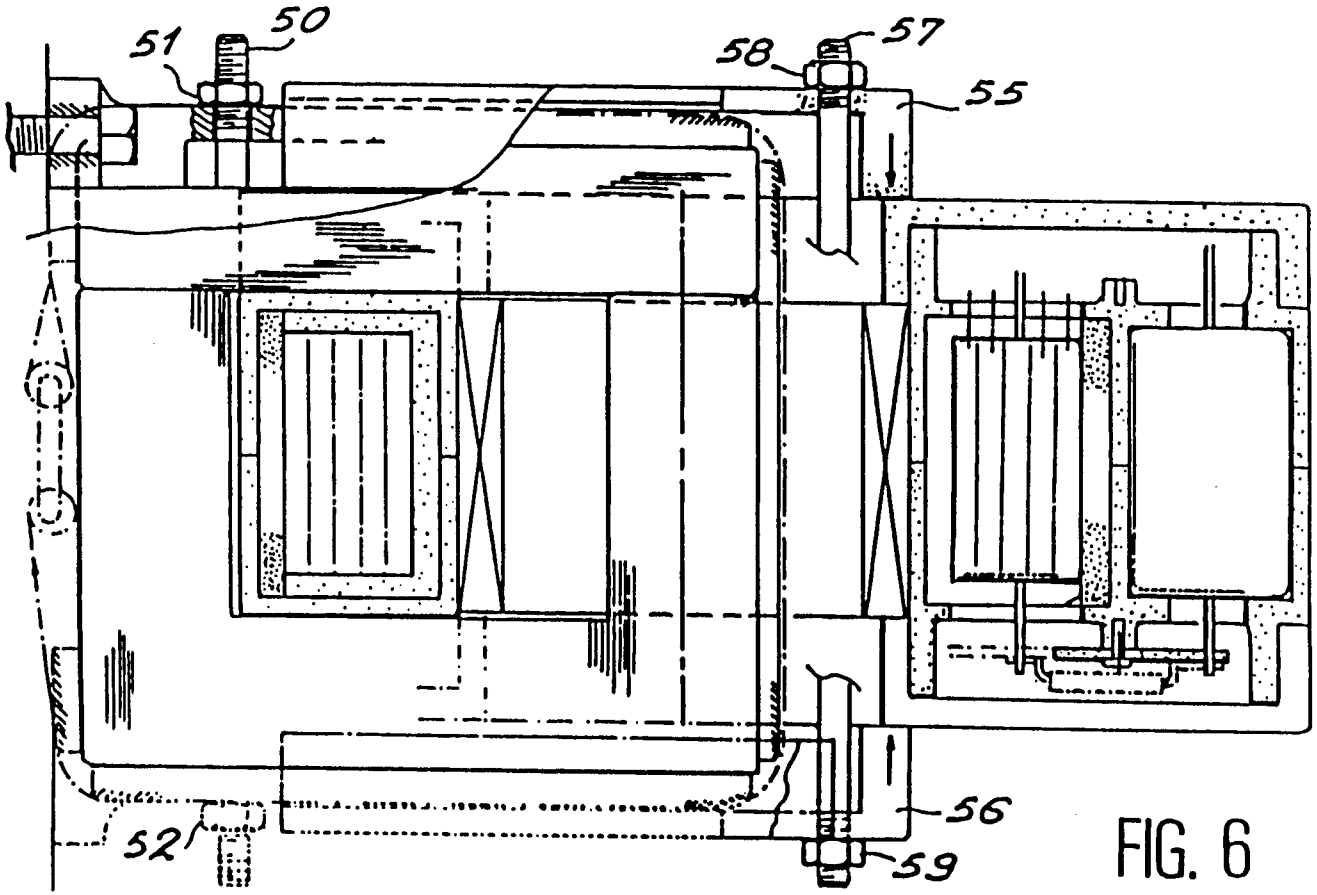
FIG. 6 is a section view through the prior art power supply assembly on a plane including the axis x'x and the magnetic circuit of the transformer.

As mentioned with reference to the description of FIG. 1, the electric circuit 99 is constituted by a resistor R' and a variable capacitor C' in parallel with a discharge gap 9'.

A sixth cell 100 in half-shell 81 and a seventh cell 100' in half-shell 81' are provided for receiving and holding respective transformers 101 and 101' for the power supply circuits for the cathode filaments of the X-ray tube.

The various cells described above are separated from one another by partitions such as that referenced 102 and the shapes of the partitions coincide with the shape of the components that they are in&ended to hold. These partitions are pierced by orifices such as that referenced 103 in partition 102' in order to allow the cooling liquid to flow.

In order to fill the tank 80 constituted by the two half-shells 81 and 81' with the cooling and insulating medium, two orifices 104 and 104' are provided through the side walls 85 and 85' respectively, and they are closed by respective plugs 105 and 105'.

Other inlet and outlet orifices may also be provided if provision is made for circulating the cooling liquid.

After installing and wiring the various components of the secondary circuit in the half-shells 81 and 81', these half-shells are assembled together so as to form a fluid-tight tank on the outside of which the various components of the primary circuit and of the magnetic circuit are then mounted.

Thus, the primary winding 12 is disposed inside the tunnel 89, 89', whereas the branch 34 of the magnetic circuit 35 passes through the tunnel 89, 89' inside the primary winding 12. The branch 60 is placed in the vertical portion of the notch 90 and the branch 44 is placed in the horizontal portion of said notch.

Finally, the fourth branch 46 is placed in the vertical portion of notch 90' between the ends of the branches 34 and 44.

In a variant, instead of being supported by the tunnel, the primary winding may be supported by the magnetic circuit itself.

In order to hold these various components of the magnetic circuit together, plates are provided such as the plate referenced 106 on half-shell 81, which plates are fixed to the main walls 83 and 83'. These plates support connection tabs 107 for the primary winding. The plate 106 may also be used to support a fan 108 for cooling the primary winding and the magnetic circuit by providing a forced high-speed flow of air through the tunnel 89 or 89'.

The two half-shells 81 and 81' of the enclosure 80 are made of an insulating substance, e.g. a plastic. In order to provide electrical protection, the outside wall of each half-shell 81 and 81' is covered with a metal casing or a conducting layer which is provided in such a manner as to avoid short-circuiting the secondary winding disposed inside the half-shells. The metal casing or the conducting layer is connected to ground potential.

The insulating and cooling fluid with which the enclosure 80 is filled may be constituted by an insulating resin which, in combination with the two half-shells 81 and 81' constitutes a mold encapsulating the components contained therein. By acting in this way, it is no longer necessary to make use of an encapsulation mold during manufacture, thereby avoiding the length of time required for assembling and disassembling the mold.

Figure 7:
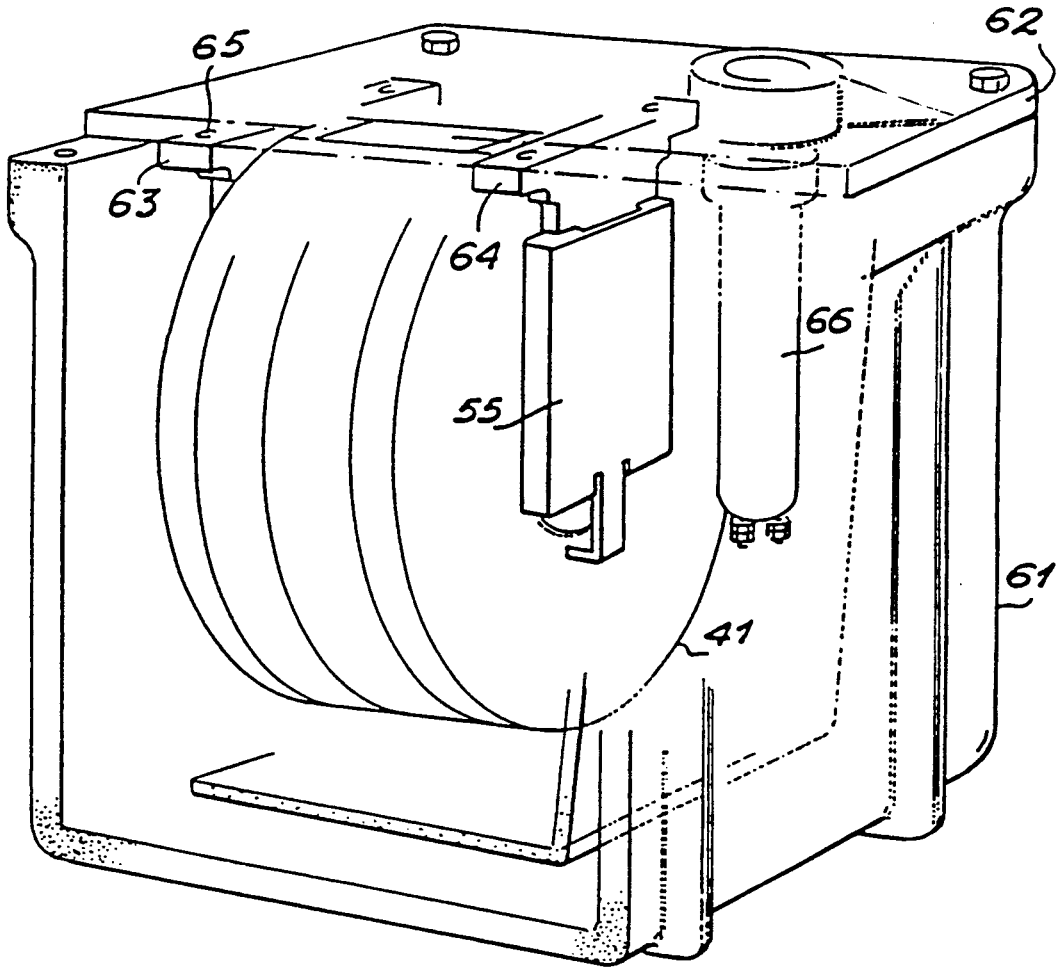
FIG. 7 is a partially cut-away perspective view of the prior art power supply shown placed inside a compartment filled with a cooling and insulating liquid.

The invention is described above with reference to a particular embodiment in which only the enclosure 80 is filled with an insulating and cooling liquid, with the outside of the enclosure being in open air. However, there is no reason why the enclosure 80 and the components it supports should not be placed inside a tank analogous to the tank 61 of FIG. 7, which tank could be filled with a cooling fluid. Such an arrangement is applicable regardless of whether the enclosure 80 is filled with an insulating and cooling liquid which may be circulated or not, or whether the enclosure 80 is filled with a resin as mentioned above. The high-voltage block of the invention has the following advantages:

it does not have a metal tank but has an enclosure made of insulating material covered with a conducting casing or a conducting layer, thereby reducing manufacturing costs;

the volume and the weight of the high-voltage block are considerably reduced by reducing the volume of insulating and cooling liquid and by using an enclosure 80 made of an insulating material such as a plastic; and the heat dissipated by the electrical and magnetic components of the primary circuit and of the secondary circuit can be evacuated by forced or non-forced circulation of a cooling fluid and different cooling fluids may be used for the primary circuit and the secondary circuit, thereby enabling each of them to be specifically designed for the purpose.

What is claimed is:

1. A high-voltage power supply for an X-ray tube, said power supply comprising a transformer having at least one primary winding, a plurality of secondary windings having two output terminals each, and a magnetic circuit, said output terminals of each of said secondary windings being connected to a rectifier and voltage-doubler circuit constituted by two diodes and two filter capacitors, said rectifier and voltage-doubler circuits being interconnected so that their output voltages are added, said primary and secondary windings of the transformer being wound as concentric coils, said output terminals of said secondary windings being distributed on each of the sides of said coils, said capacitors being disposed on the outer periphery of the coils, and said diodes being disposed on one of the sides of said coils, wherein said secondary windings of the transformer, said capacitors, and said diodes, are all disposed in an enclosure which is filled with an insulating and cooling medium, said primary winding and said magnetic circuit being disposed outside said enclosure and wherein said enclosure is made of two half-shells which each include cells for housing and holding at least the components connected to a high voltage.

2. A power supply according to claim 1, wherein said enclosure is also designed to house at least one transformer for powering a cathode filament of said X-ray tube.

3. A power supply according to claim 1 wherein said enclosure is also designed to house an expansion tank for the cooling liquid.

4. A power supply according to claim 1, wherein said enclosure is designed to house an electric circuit for the measuring high-voltage.

5. A power supply according to claim 1 wherein said enclosure is designed to house supports for connection tabs which are installed via orifices pierced through the side walls.

6. A power supply according to claim 1, wherein the walls of said cells are shaped to coincide with the shapes of the components that they hold, and include orifices for allowing a cooling and insulating liquid to flow.

7. A power supply according to claim 1, wherein the central portion of each half-shell includes a tunnel which passes right through it and which serves as a support on the inside of the enclosure for said secondary windings and on the outside of the enclosure for said primary winding, said tunnel having a branch of said magnetic circuit going therethrough and each said half-shell including a notch engaging the tunnel and serving to house and hold the other branches of said magnetic circuit, said branches of said magnetic circuit being held together and to said half-shells by plates fixed to the walls of said half-shells, said plates including connections tabs for said primary winding.

8. A power supply according to claim 1, wherein said enclosure is made of an insulating substance and said enclosure being covered with a conducting layer which provides electrical protection without short-circuiting the secondary winding.

9. A power supply according to claim 1, wherein said enclosure is filled with an insulating and cooling fluid.

10. A power supply according to claim 1, wherein said enclosure is filled with an insulating settable resin.

11. A power supply according to claim 1, wherein it further includes means for circulating and cooling the insulating and cooling fluid contained in said enclosure.

* * * * *